US009752580B2

(12) United States Patent
Tommasini

(10) Patent No.: US 9,752,580 B2
(45) Date of Patent: Sep. 5, 2017

(54) POSITIVE DISPLACEMENT GEAR PUMP

(71) Applicant: G.P.S. GREEN POWER SOLUTION SA, Lugano (CH)

(72) Inventor: Franco Tommasini, Asmara (ER)

(73) Assignee: G.P.S. GREEN POWER SOLUTION SA, Lugano (CH)

( * ) Notice: Subject to any disclaimer, the term of this patent is extended or adjusted under 35 U.S.C. 154(b) by 0 days.

(21) Appl. No.: 14/783,002

(22) PCT Filed: Sep. 23, 2014

(86) PCT No.: PCT/EP2014/070228

§ 371 (c)(1),
(2) Date: Oct. 7, 2015

(87) PCT Pub. No.: WO2015/044131

PCT Pub. Date: Apr. 2, 2015

(65) Prior Publication Data

US 2016/0047377 A1 Feb. 18, 2016

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/08*** | (2006.01) |
| ***F01C 1/12*** | (2006.01) |
| ***F04C 2/12*** | (2006.01) |
| ***F04C 2/20*** | (2006.01) |
| ***F04C 15/00*** | (2006.01) |
| ***F04C 18/12*** | (2006.01) |

(Continued)

(52) U.S. Cl.

CPC ..... *F04C 18/08* (2013.01); *F01C 1/123* (2013.01); *F04C 2/08* (2013.01); *F04C 2/123* (2013.01); *F04C 2/20* (2013.01); *F04C 15/0026* (2013.01); *F04C 15/0088* (2013.01); *F04C 18/123* (2013.01); *F04C 27/006* (2013.01); *F04C 29/02* (2013.01)

(58) Field of Classification Search

CPC .... F04C 2/08; F04C 2/123; F04C 2/20; F04C 15/0026; F04C 15/0088; F04C 18/08; F04C 18/123; F04C 27/006; F04C 29/02; F01C 1/123

USPC ..... 418/206.1–206.9, 191, 178–179

See application file for complete search history.

(56) References Cited

U.S. PATENT DOCUMENTS

2011/0135525 A1 6/2011 Lurtz

FOREIGN PATENT DOCUMENTS

DE 3537803 A1 4/1987
DE 9209641 U1 11/1992

(Continued)

OTHER PUBLICATIONS

International Search Report for corresponding International Application No. PCT/EP2014/070228.

*Primary Examiner* — Theresa Trieu

(74) *Attorney, Agent, or Firm* — Egbert Law Offices, PLLC

(57) ABSTRACT

A positive displacement pump has a casing with a central body and two closing lids, the central body being provided with two cylindrical communicating chambers, one suction pipe and one discharge pipe, and two rotors revolvingly mounted in the chambers of the central body and supported by shafts revolvingly mounted in the closing lids. The two rotors include a male rotor having only protuberances, not cavities, and a female rotor having only cavities, not teeth or protuberances.

11 Claims, 7 Drawing Sheets

(51) Int. Cl.

| | |
|---|---|
| ***F04C 27/00*** | (2006.01) |
| ***F04C 29/02*** | (2006.01) |
| ***F04C 2/08*** | (2006.01) |

(56) References Cited

FOREIGN PATENT DOCUMENTS

| | | | |
|---|---|---|---|
| FR | 2497881 | A1 | 7/1982 |
| GB | 749569 | A | 5/1956 |
| WO | 8801694 | A1 | 3/1988 |
| WO | 9804809 | A1 | 2/1998 |

POSITIVE DISPLACEMENT GEAR PUMP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a positive displacement gear pump.

2. Description of Related Art Including Information Disclosed Under 37 CFR 1.97 and 37 CFR 1.98.

Various types of positive displacement pumps with internal gears are known on the market, being used to transport liquid or gaseous fluids from a suction pipe to a discharge pipe of the pump.

FIG. 1 shows a positive displacement gear pump according to the prior art, generally indicated with reference numeral (101). The pump (101) comprises a casing (102) with suction pipe (I) and discharge pipe (O). Two identical rotors (103) are mounted inside the casing (102). Each rotor (103) comprises a gear composed of a toothed wheel. Each rotor comprises a plurality of linear or helicoidal teeth (130) that define a plurality of cavities (131) between said teeth (130).

The two gears (103) are engaged in such manner that the teeth (130) of one gear are engaged into the cavities (131) of the other gear, and vice versa. So the fluid enters the suction pipe (I) and comes out of the discharge pipe (O).

This type of positive displacement pumps of the prior art is impaired by drawbacks caused by fluid encapsulation. As a matter of fact, the fluid treated by the pump is trapped in the cavities of the rotor and compressed by the teeth of the other rotor, thus generating micro-explosions. Said micro-explosions considerably reduce the number of rotor revolutions, causing a considerable wear of the rotors and generating failure points in the rotor toothing.

Vane pumps are additionally known, comprising a rotor provided with cavity in which vanes slide radially. The rotor is mounted eccentrically with respect to the seat of the casing where it is housed and the vanes are stressed by springs or by the centrifugal force towards the surface of the rotor housing.

Said vane pumps permit a limited number of revolutions, cause early wear of vanes and require oil lubrication and consequently a separator to separate oil from the fluid treated by the pump.

US2011/0135525 discloses a non-eccentric motor comprising male rotors provided with protuberances and female rotors provided with cavity engaged by the protuberances of the male rotor. However, the male rotors have a particular shape of the protuberances which difficult to make, since the protuberance are obtained in a single piece with the rotor body.

The purpose of the present invention is to overcome the drawbacks of the prior art, by disclosing a positive displacement gear pump capable of avoiding fluid encapsulation.

Another purpose of the present invention is to obtain such a positive displacement gear pump that is able to operate with a high number of revolutions and is extremely reliable and safe.

BRIEF SUMMARY OF THE INVENTION

These purposes are achieved according to the invention with the characteristics claimed in the attached independent claim.

Advantageous embodiments appear from the dependent claims.

The positive displacement pump of the invention comprises:

- a casing that comprises a central body and two closing lids, said central body being provided with two communicating cylindrical chambers, one suction pipe and one discharge pipe, and
- two rotors revolvingly mounted in said chambers of the central body and supported by corresponding shafts revolvingly mounted and supported in said closing lids.

The two rotors comprise:

- a male rotor that only comprises protuberances, not cavities, and
- a female rotor that only comprises cavities, not protuberances or teeth.

The male rotor is engaged with the female rotor, i.e. the protuberances of the male rotor are engaged in the cavities of the female rotor without contact between the two rotors.

The provision of male rotor and female rotor avoids fluid encapsulation in the cavities of the female rotor. Consequently, the pump of the invention can be used at a high number of revolutions, with minimum stress for mechanical moving parts.

In particular, the male rotor comprises a cylindrical body provided with seats. The protuberances consist of sector comprising a base engaging into the seat of the cylindrical body of the rotor. Said feature allows a simply realization of the protuberances, according to suitable geometry, as disclosed following.

BRIEF DESCRIPTION OF THE DRAWINGS

Additional characteristics of the invention will appear evident from the detailed description below, with reference to the attached drawings, which have an illustrative, not limitative purpose only, wherein.

DETAILED DESCRIPTION OF THE INVENTION

Figure 1:
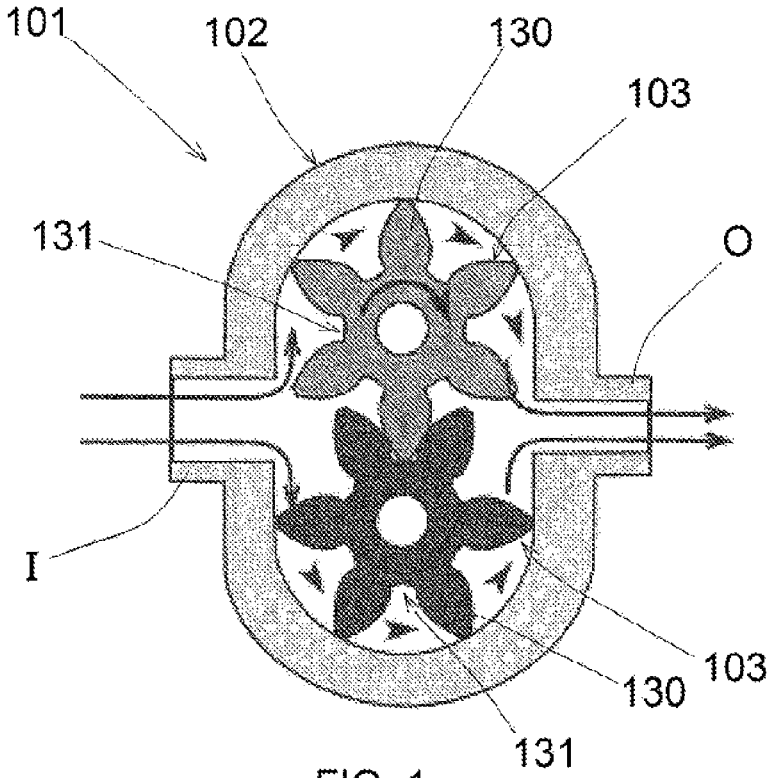
FIG. 1 PRIOR ART
FIG. 1 is cross-sectional view of a positive displacement gear pump according to the prior art.
Figure 2:
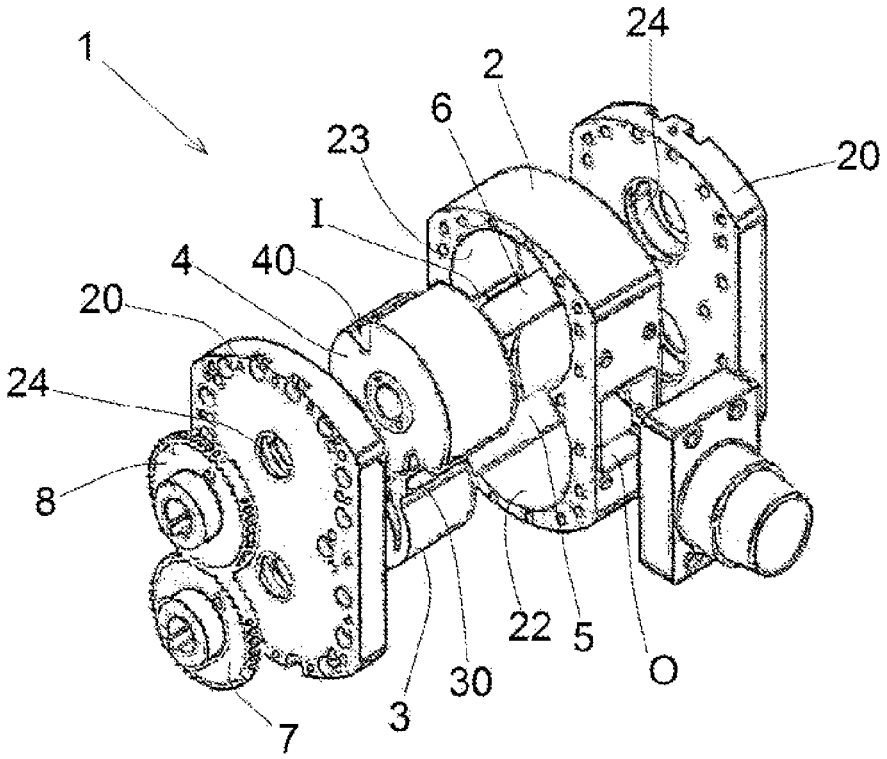
FIG. 2 is an exploded perspective view of the positive displacement gear pump according to the invention.
Figure 3:
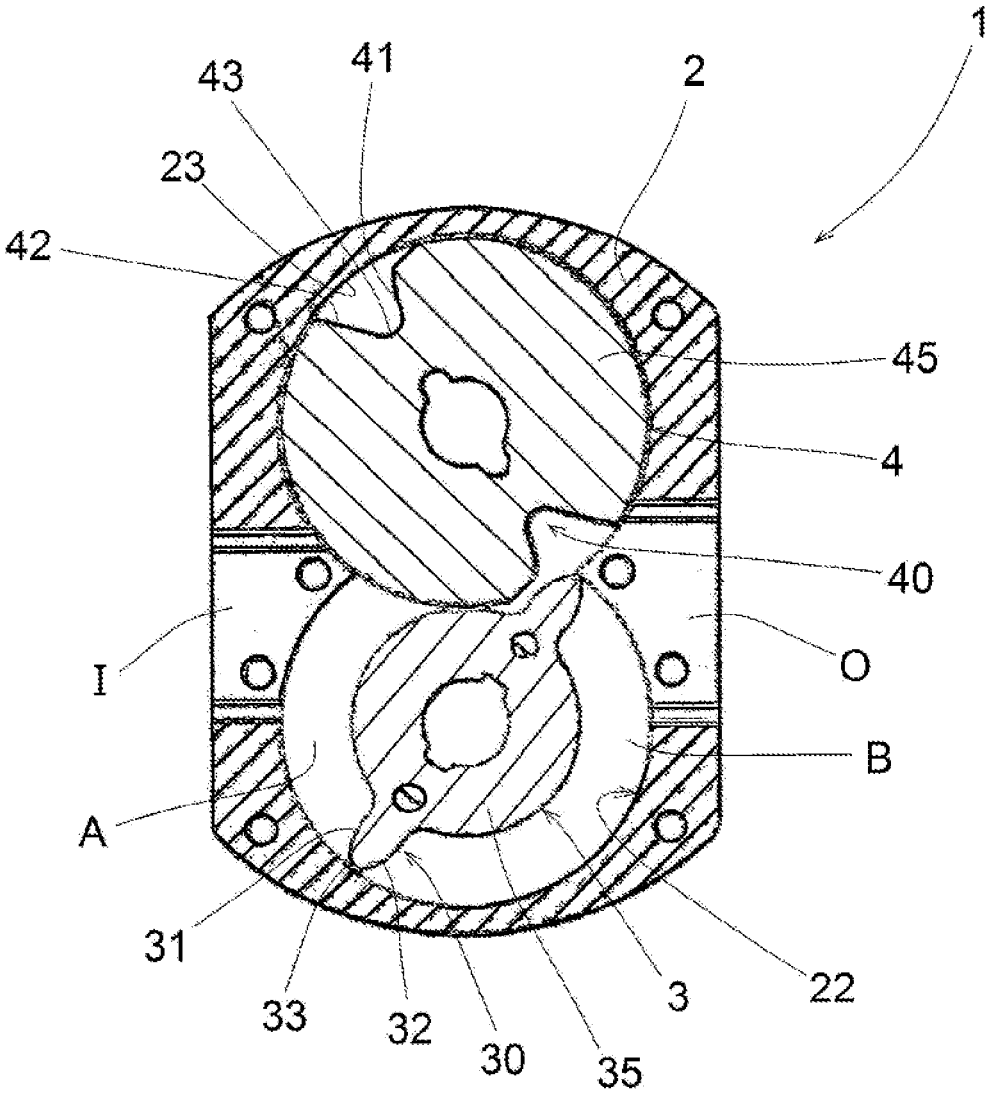
FIG. 3 is a cross-sectional view of the pump of FIG. 2 in assembled condition.
Figure 4:
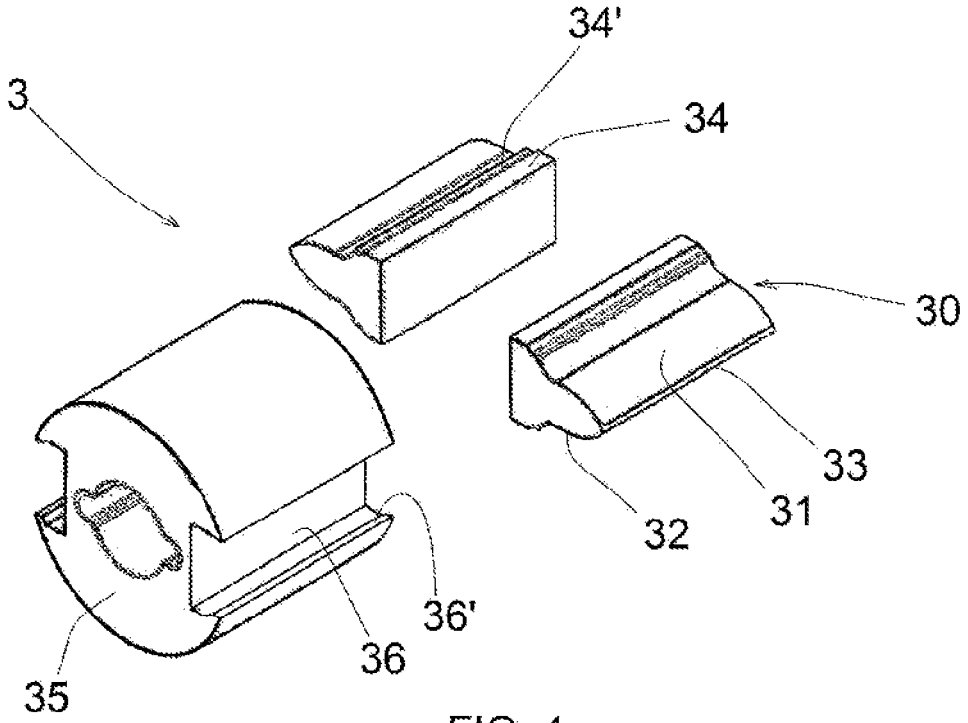
FIG. 4 is an exploded view of a male rotor of the pump shown in FIG. 2.

Referring now to FIGS. 2, 3 and 4, a positive displacement pump according to the invention is disclosed, generally indicated with reference numeral (1).

The pump (1) comprises a casing provided with central body (2) sealed by means of two plate-shaped closing lids (20).

The central body (2) comprises two communicating cylindrical chambers (22; 23) in such manner to form a basically 8-shaped opening that is closed by the two lids (20). The central body is provided with two pipes (I, O) in communication with outside, respectively to suck and discharge the fluid treated by the pump.

A male rotor (3) and a female rotor (4) are disposed in the cylindrical chambers (22, 23) of the central body. The male rotor (3) comprises only protuberances (30), not cavities. Instead, the female rotor (4) comprises only cavities (40), not teeth or protuberances. The male rotor (3) is engaged with the female rotor, i.e. the protuberances (30) of the male rotor are engaged in the cavities (40) of the female rotor without contact between the two rotors.

The male and female rotors (3, 4) are mounted on corresponding shafts (5, 6). The shafts (5, 6) of the rotors are revolvingly supported on supports (bushes or bearings, not shown in the figures) provided in the seats (24) of the lids (20).

Preferably, the shaft (6) of the female rotor is connected to a drive shaft. Therefore, the female rotor (4) is the driving gear and the male rotor (3) is the driven gear. However, also the shaft (5) of the male rotor can be connected to a drive shaft. Moreover, both shafts (6, 5) of the rotors can be simultaneously connected to two drive shafts in such manner to obtain better torque distribution.

According to the rotation direction of the drive shaft, the pipes (I, O) of the central body can act as suction pipe or discharge pipe.

Advantageously, two external gears (7, 8) are disposed outside the casing and keyed to the shafts (5, 6) of the rotors. The external gears (7, 8) are engaging toothed wheels. The external gears allow for phasing the male and female rotors (3, 4), meaning that during the rotation of the two rotors, the protuberances (30) of the male rotor enter the cavities (40) of the female rotor.

As shown in FIG. 3, the male rotor (3) comprises a cylindrical body (35) and a plurality of protuberances (30) radially protruding from the cylindrical body (35). Each protuberance (30) cross-sectionally comprises two flex shaped sides (31, 32) converging into a rounded or flat head (33). The flex shaped side is a curve that has a flex. The flex or inflection (inflexion) is a point on a curve at which the curvature or concavity changes sign from plus to minus or from minus to plus. The curve changes from being concave (positive curvature) to convex (negative curvature), or vice versa.

The two sides (31, 32) of a protuberance are symmetrical with respect to a radial axis of symmetry passing through the head 33 of the protuberance.

Advantageously, the male rotor (3) comprises two protuberances (30) in diametrally opposite positions. In such a case, the chamber (22) of the central body of the casing defines a suction area (A) in communication with the suction pipe (I) and a discharge area (B) in communication with the discharge pipe (O).

The female rotor (4) comprises a cylindrical body (45) wherein a plurality of radially extending cavities (40) is obtained. Each cavity (40) cross-sectionally comprises two flex-shaped sides (41, 42) joined into a bottom surface (43) with concave shape. The profiles of the two sides (41, 42) of the cavity are not symmetrical with respect to a radial straight line passing through the bottom of the cavity. The flex-shaped profile of the inlet side (41) is shorter and has a higher curvature than the flex-shaped profile of the outlet side (42) of the cavity. The flex-shaped profile of the outlet side (42) is almost rectilinear.

Advantageously, the female rotor (4) comprises two cavities (40) in diametrally opposite positions.

The heads (33) of the protuberances of the male rotor are very close to the internal surface of the cylindrical chamber (22). During operation, the heads (33) of the protuberances of the male rotor arrive at a short distance from the bottom (43) of the cavity, thus avoiding the passage of liquid. However, the heads (32) of the protuberances do not touch the internal surface of the cylindrical chamber (22) or the bottom (43) of the cavity of female rotor.

Moreover, the external surface of the cylindrical body (45) of the female rotor is almost tangent to the internal surface of the cylindrical chamber (23) of the central body of the casing, in such manner to avoid the passage of liquid.

Similarly, the external surface of the cylindrical body (45) of the female rotor is almost tangent to the external surface of the cylindrical body (35) of the male rotor.

The male rotor (3) and female rotor (4) are perfectly centered in the corresponding cylindrical chambers (22, 23) in such manner to leave a tolerance space of 0.05 mm, preferably 0.02 mm, between the following parts:

- between the heads (33) of the protuberances of the male rotor and the internal surface of the cylindrical chamber (22) of the central body,
- between the heads (33) of the protuberances of the male rotor and the bottom surface (43) of the cavities of the female rotor,
- between the external surface of the cylindrical body (45) of the female rotor and the internal surface of the cylindrical chamber (23) of the central body of the casing,
- between the external surface of the cylindrical body (45) of the female rotor and the external surface of the cylindrical body (35) of the male rotor.

FIG. 3 shows an additional embodiment, wherein the head diameter (meaning the distance between the heads (33) of two diametrally opposite protuberances) of the male rotor (3) is identical to the diameter of the cylindrical body (4) of the female rotor, in such manner to obtain two chambers (22, 23) with identical diameter and make synchronization of the two rotors easier. However, when the diameter of the cylindrical body (35) of the male rotor (3) is smaller than the diameter of the cylindrical body (45) of the female rotor (4), a minimum tolerance must be provided between the two cylindrical bodies (35, 45) because the peripheral speeds of the two cylindrical bodies (35, 45) are different and a contact between them would cause a considerable friction, preventing the rotation of the two rotors.

In order to remedy such a drawback, the diameter of the cylindrical body (35) of the male rotor can be identical to the diameter of the cylindrical body (45) of the female rotor. In this way, the peripheral speed of the two cylindrical bodies (35, 45) of the two rotors is identical and the tolerance between cylindrical bodies (35, 45) of the two rotors may be zero, thus allowing for contact between the cylindrical bodies (35, 45) of the two rotors during rotation. Consequently, losses are minimized and high rotational speeds are allowed. Moreover, in such a case, the chamber (22) that houses the male rotor (3) is larger than the chamber (23) that houses the female rotor (4), thus increasing the delivery capacity of the pump (1), while maintaining the same size of the protuberance module (31).

It must be noted that, because of the special configuration of the cavities (40) of the female rotor and because there are no contact parts between rotors (3, 4) and casing, the fluid is not trapped in the pump (1) and the pump (1) can operate at a high number of revolutions, thus reducing wear and failure of mechanical parts.

As shown in FIG. 4, the male rotor (3) is made in different parts that are mutually assembled. For instance, seats (36) are obtained in the cylindrical body (35), cross-sectionally having a substantially C-shaped or dovetail profile.

In such a case, the protuberances (30) consist in sectors provided with a substantially parallelepiped base (34) that is engaged into the seat (36). The base (34) of the protuberance can be provided with ribs or grooves (34') that are engaged with corresponding ribs or grooves (36') provided in the seat (36) of the cylindrical body of the male rotor.

The entire rotors (3, 4) or only the protuberances (30) and/or cavities (40) can undergo thermal and/or chemical treatments and can be coated with suitable materials, such as hard metal, Widia, rubber, plastics, Teflon or ceramic.

Figure 5:
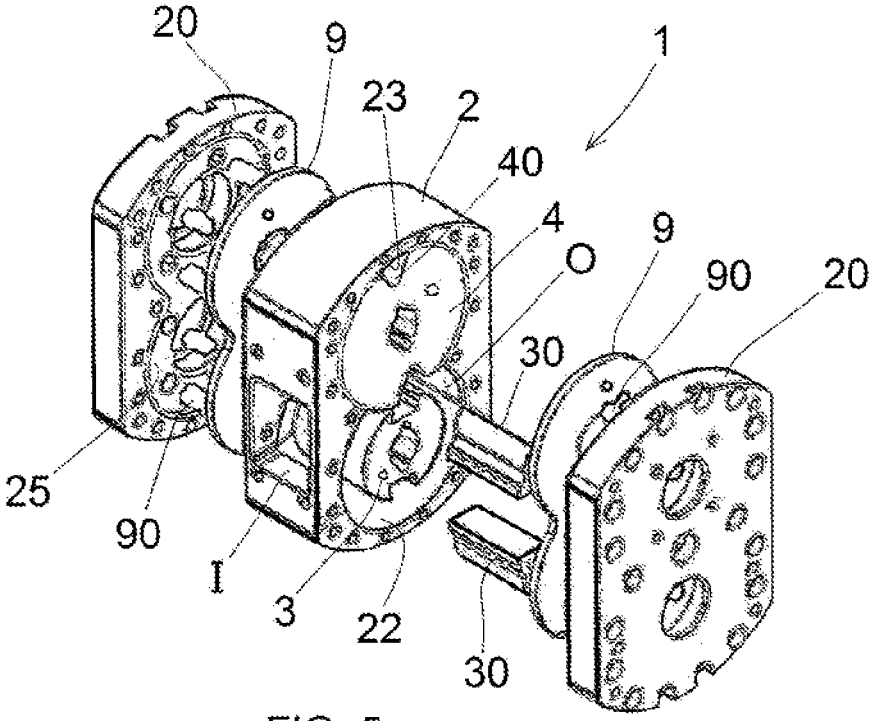
FIG. 5 is an exploded perspective view of an additional embodiment of the pump shown in FIG. 2.

As shown in FIG. 5, the pump (1) also comprises two seal gaskets (9) composed of 8-shaped plates made of anti-friction self-lubricating material. The seal gaskets (9) are disposed between the central body (2) and the lids (20). The surface of the lids facing towards the central body is provided with suitable recessed seats (25) adapted to house the seal gaskets (9). Springs (90) are disposed in the seats (25) of the lids in such manner to stress the seal gaskets (9) towards the central body. In such a way, the seal gaskets (9) are stopped against the planar sides of the male and female rotors (3, 4). Such a solution provides for tightness of the chambers (22, 23) obtained inside the central body (20), thus avoiding losses due to construction tolerance. In this way, if the rotors (3, 4) are coated with anti-friction self-lubricating material, the pump (1) can be used at a high number of revolutions, without oil and with minimum wear for mechanical moving parts.

With references to FIGS. 6-10 a pump (201) according a second embodiment of the invention is disclosed, wherein elements equal or correspondent to the ones previously disclosed, are indicated with the same references number and the detailed description thereof is omitted.

The pump (201) comprises a male rotor (3) having a body (35) with a diameter double with respect to the diameter of the body (45) of the female rotor. In this case, the female rotor (4) rotates a double speed with respect to the male rotor; therefore the male rotor (3) has two protuberances (30) diametrally opposed and the female rotor (4) has only one cavity (40).

Figure 9:
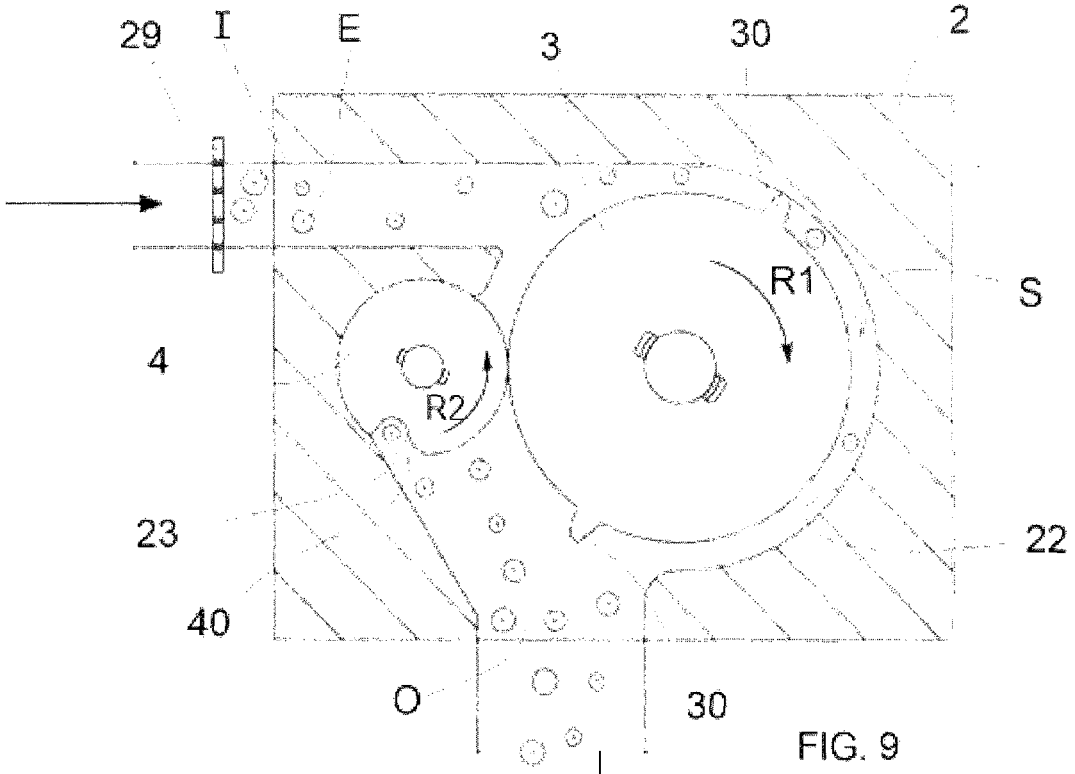
FIGS. 9 and 10 are cross-section views of the pump of FIG. 7 in two different positions of the rotors.

With references to FIG. 9, the female rotor (4) and the male rotor (3) are disposed side by side. The pump (201) comprises:

- a suction duct (I) disposed over the chambers (22, 23) of the two rotor, and
- a delivery duct (O) disposed under the chambers (22, 23) of the two rotor, and having an axis orthogonal with respect the axis of the suction duct (I).

Said description refer to the arrangement of FIG. 9, it is evident the pump (201) can be rotated as required. It is important that the suction and delivery ducts (I, O) are disposed on one part and on the other part with respect to the rotor (3, 4) and the ducts (I, O) must have orthogonal axes each others.

In this manner the male rotor (3) rotates in the direction of the arrow (R1) and the female rotor (4) rotates in the direction of the arrow (R2).

Advantageously, the diameter of the delivery ducts (O) in greater than twice of the diameter of the suction duct (1), so that the expulsion of the fluid is facilitated, without generating counter-pressures into the chamber (23) of the female rotor, under the female rotor, since said counter-pressures counteract against the rotation direction (R2) of the female rotor. As matter the fact, any counter-pressures impinges into the cavity (40) of the female rotor, in contrast to the rotation direction (R2) of the female rotor.

Figure 10:
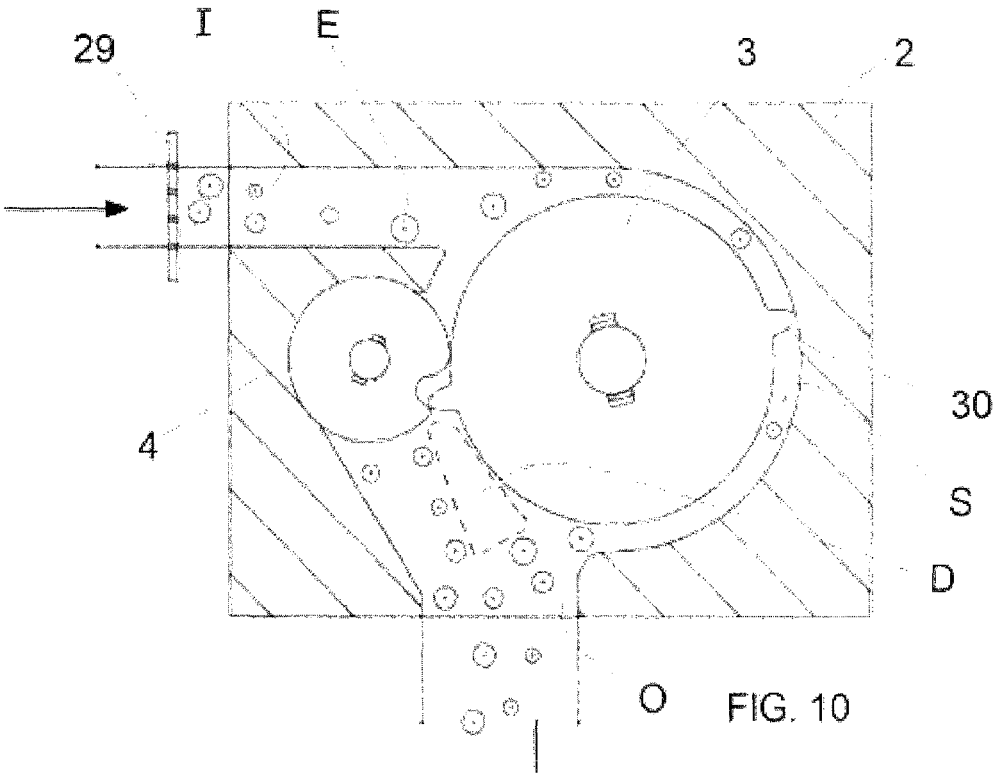

With references to FIG. 10, during the mesh of the protuberance (30) of the male rotor into the cavity (40) of the female rotor, an empty space (D) (evidenced in dotted line), under meshing portion of the rotor, directed toward the delivery duct (O). Said empty space (D) is totally empty of liquid, in order to not generate counter-pressures in contrast with the rotation directions (R1, R2) of the rotors.

The configuration of the chambers (22, 23), the sizes of the rotors (3, 4) and the arrangement of the suction and delivery ducts (I, O) allow for a easy expulsion of foreign bodies (E) which can enter into the suction duct (I). Said foreign bodies (E) can not get stuck between the cavity (40) of the female rotor and the protuberance (30) of the male rotor.

A grid (29) is disposed at the inlet of the suction duct (I). Therefore the size of the foreign bodies (E) is defined by the size of the holes of the grid (29). Said size is minor than the space (S) between the external diameter of the body (35) of the male rotor and the internal diameter of the chamber (22) of the male rotor. I. e, the space (S) I substantially equal to the length of the protuberance (30). Therefore, the holes of the grid (29) have a diameter less than the length of the protuberance (30) of the male rotor.

With references to FIG. 10, the outlet side (42) of the cavity (40) is defined between a point P1 joined with the circumference of the body (45) of the female rotor and a point P2 joined with the bottom surface (43) of the cavity. The inlet side (31) of the protuberance (30) is defined between a point F1 joined with the circumference of the body (35) of the male rotor and a point F2 joined with the head (33) of the protuberance (30). The segment between P1 and P2 must be longer than the segment between F1, F2. I. e., the cord (C) subtending the outlet side (42) of the cavity must be longer than the cord (H) subtending the inlet side (31) of the protuberance.

In this manner, the liquid under pressure, entrapped into the space between the inlet side (31) of the protuberance and the outlet side (42) of the cavity, does not generate strengths contrasting the rotation direction of the two rotors. As result, a rotation motion of the two rotors (3, 4) is obtained without dead spots.

Figure 6:
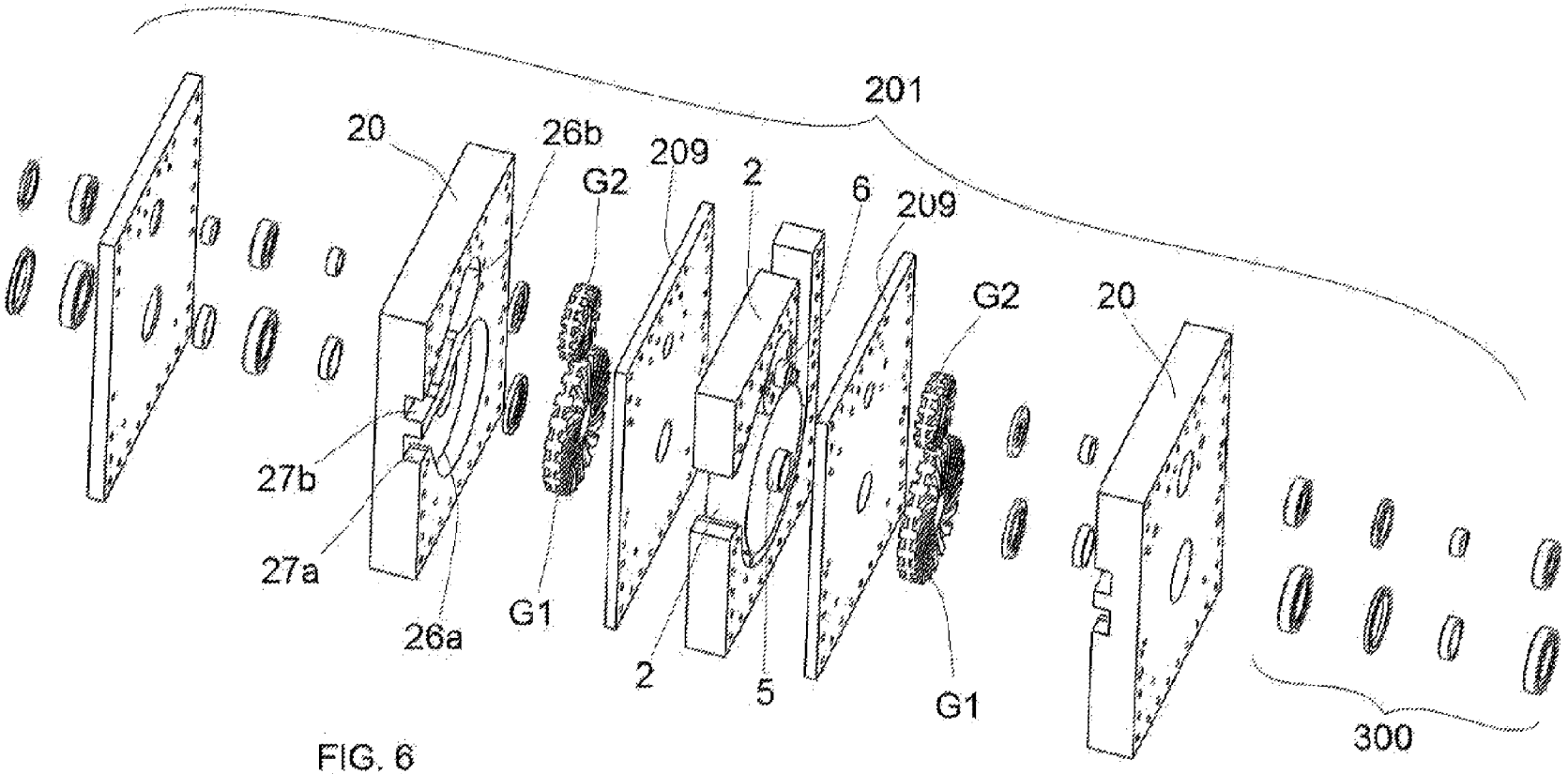
FIG. 6 is an exploded perspective view showing a second embodiment of the pump according to the invention.
Figure 7:
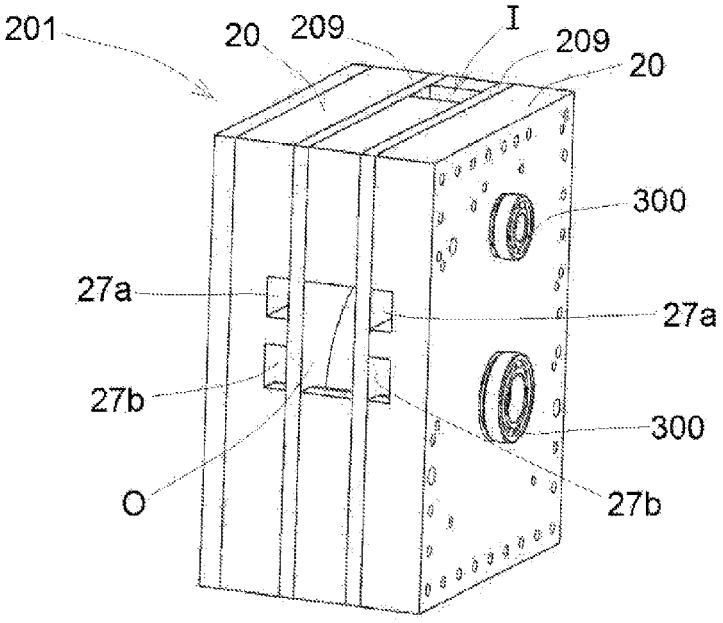
FIG. 7 is an assembled perspective view of the pump of FIG. 6.
Figure 10A:
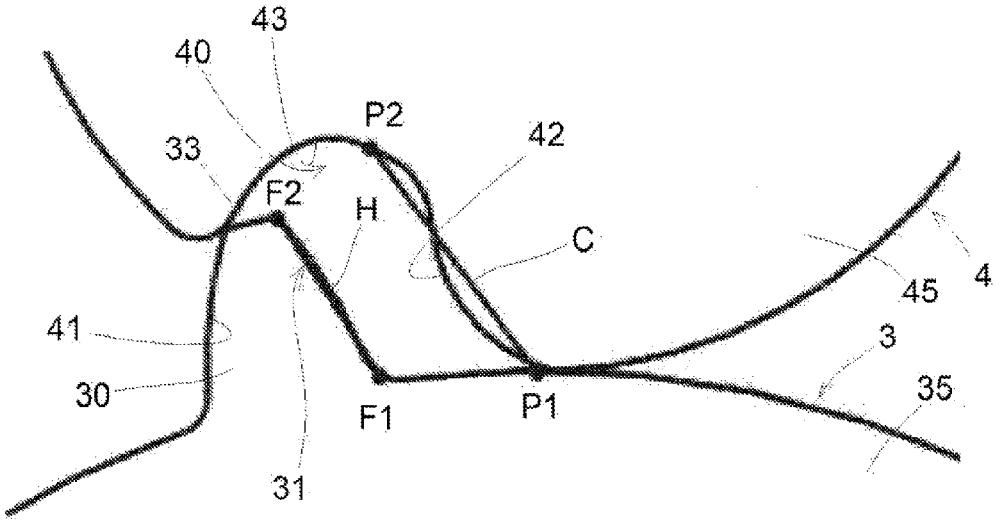
FIG. 10A is an enlarged detail of FIG. 10.
Figure 8:
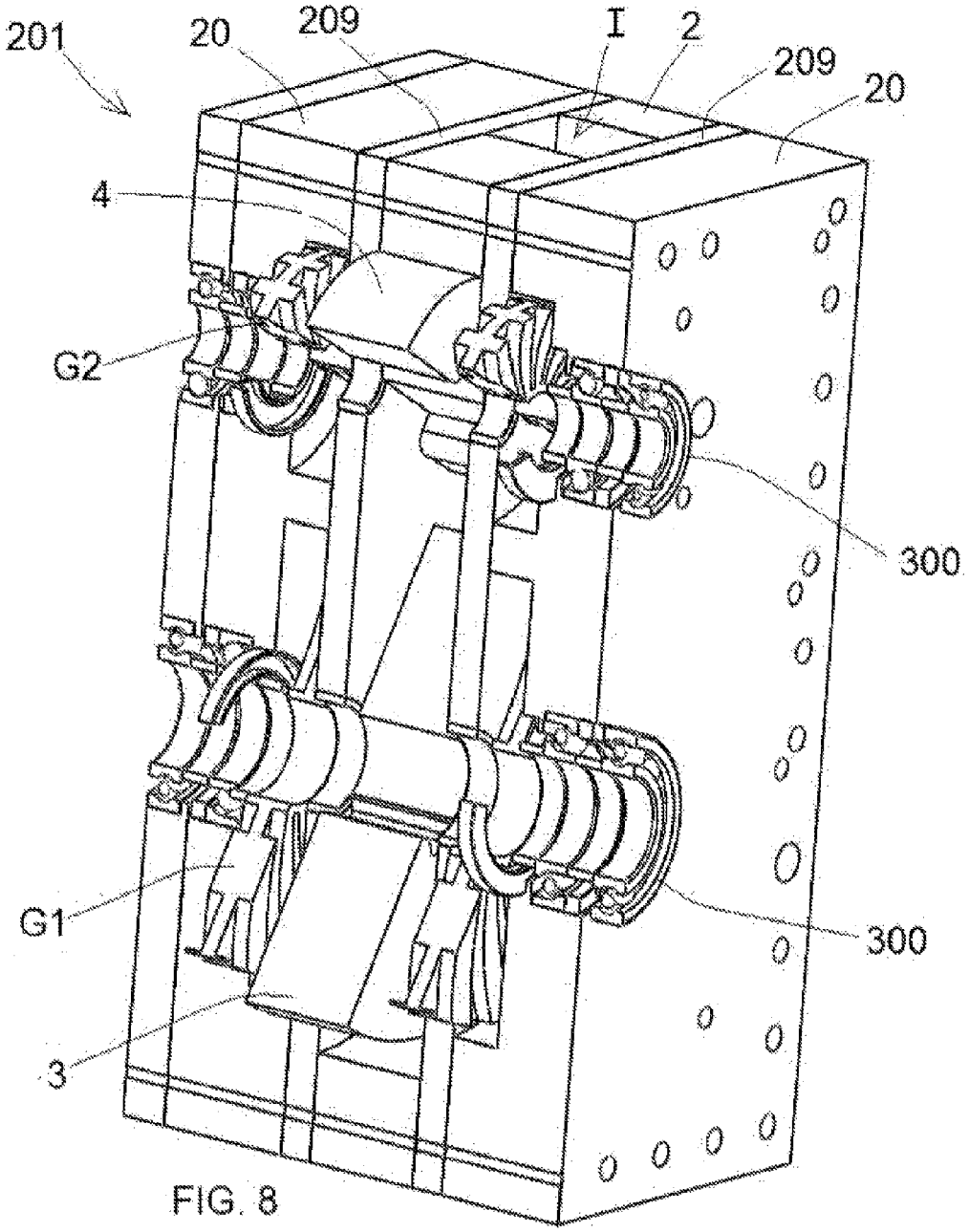
FIG. 8 is a perspective view of the pump of FIG. 7 in axial section.

With references to the FIGS. 6, 7 and 8, the central body (2) of pump is disposed between two sealing plates (209). A first impeller (G1) is connected to the shaft (5) of the male rotor and a second impeller (G2) is connected to the shaft (6) of the female rotor. The impellers (G1, G2) are outside of the respective sealing plates (209). Chambers (26*a*, 26*b*) are obtained in the internal surface of the lids (20). The impellers (G1, G2) can respectively rotates in the chambers (26*a*, 26*b*) obtained in the lids (20). The chambers (26*a*, 26*b*) of the impellers communicate with exhaust ducts (27*a*, 27*b*) obtained in the lids (20).

In this manner, any fluid losses passing through the sealing plates (209) are centrifuged by the impellers (G1, G2) into the chambers (26*a*, 26*b*) of the impellers and conveyed toward the exhaust ducts (27*a*, 27*b*) obtained in the lids (20). As result there are not pressure limits imposed on oil-seal or dust-seal (300) mounted around the shafts (5, 6) of the rotors. The impellers (G1, G2) allows to use any type of oil-seal or dust-seal (300) in order to isolate the fluids worked by the pump from any machines or generators applied on the main shaft of the pump.

Variations and modifications can be made to the present embodiments of the invention, within the reach of an expert of the field, while still falling within the scope of the invention.

The invention claimed is:

1. A positive displacement pump comprising:

a casing having a central body and a pair of closing lids, said central body having a pair of communicating cylindrical chambers and a suction pipe and a discharge pipe; and a pair of rotors revolvingly mounted in said cylindrical chambers and supported by corresponding shafts revolvingly mounted in said pair of closing lids, said pair of rotors comprising:

a male rotor having at least one protuberance and no cavities, said male rotor having a body with at least one seat, the protuberance being positioned in a sector having a base that is engaged in a seat of a body of said male rotor, said male rotor comprising a cylindrical body, said at least one protuberance protruding radially from said cylindrical body; and a female rotor having at least one cavity and without protuberances or teeth, said male rotor meshing with said female rotor, the protuberance of said male rotor being engaged in said at least one cavity of said female rotor without contact between said pair of rotors, said female rotor comprising a cylindrical body, said at least one cavity extending radially inside said cylindrical body of said second rotor, wherein the protuberance of said male rotor comprising a pair of flex-shaped sides converging into a rounded or flat head, said pair of flex-shaped sides being symmetrical with respect to a radial axis of symmetry passing through said rounded or flat head, said pair of flex-shaped sides having an outlet side and an inlet side, said at least one cavity of said female rotor comprises a pair of flex-shaped sides joined to a bottom surface, said bottom surface having a concave shape, said pair of flex-shaped sides of said female rotor having respective profiles that are not symmetrical with respect to a radial straight line passing through a bottom of said cavity, said pair of flex-shaped sides of said female rotor comprising an inlet side and an outlet side each having a flex-shaped profile, the flex-shaped profile of said inlet side having a greater curvature than a curvature of the flex-shaped profile of said outlet side, said female rotor and said male rotor being disposed in side-by-side relation, suction and delivery ducts being disposed on one side and on another side of said male and female rotors, said suction and delivery ducts having longitudinal axes that are orthogonal to each other.

2. The positive displacement pump of claim 1, wherein a chord subtending the outlet side of the cavity is longer than a chord subtending the inlet side of the protuberance.

3. The positive displacement pump of claim 2, wherein said male rotor has two diametrally opposite protuberances and said female rotor has one cavity.

4. The positive displacement pump of claim 3, further comprising:

a pair of sealing plates disposed between said central body and said pair of closing lids;

a pair of first impellers connected to said cylindrical body of said male rotor outside of said pair of sealing plates;

a pair of second impellers connected to the shaft said cylindrical body of said female rotor outside of said pair of sealing plates; and a plurality of chambers defined in an interior surface of said pair of closing lids, wherein the impellers can rotate into the respective chambers, the chambers of the impellers communicating with exhaust ducts formed in the pair of closing lids.

5. The positive displacement pump of claim 1, wherein said male and female rotors are centered in the cylindrical chambers of said central body so as to have a tolerance space of 0.05 millimeters between the rounded or flat head of the protuberance of said male rotor and an internal surface of said cylindrical chamber of said central body, between the rounded or flat head of the protuberance of said male rotor and a bottom surface of the cavity of said female rotor, between an external surface of said cylindrical body of said female rotor and the internal surface of said cylindrical chamber of said central body of said casing, and between the external surface of said cylindrical body of said female rotor and an external surface of said cylindrical body of said male rotor.

6. The positive displacement pump of claim 1, wherein said cylindrical body of said male rotor has a diameter twice a diameter of said cylindrical body of said female rotor.

7. The positive displacement pump of claim 1, further comprising:

a pair of external gears composed of toothed wheels keyed onto the shafts of said pair of rotors outside of said casing.

8. The positive displacement pump of claim 1, further comprising:

a pair of plate-shaped seal gaskets disposed between said central body and said pair of lids; and a plurality of springs disposed between said pair of closing lids and said pair of seal gaskets in such manner to stress said pair of seal gaskets against planar sides of said pair of rotors.

9. The positive displacement pump of claim 8, wherein said pair of seal gaskets and said pair of rotors are coated with an anti-friction self-lubricating material.

10. The positive displacement pump of claim 1, wherein the delivery duct has a diameter greater than twice a diameter of the suction duct.

11. The positive displacement pump of claim 1, further comprising:

a grid disposed in an inlet of the suction duct, said grid having holes with diameter less than a length of said at least one protuberances of said male rotor.

* * * * *